US009915454B2

(12) United States Patent
Ariyama et al.

(10) Patent No.: US 9,915,454 B2
(45) Date of Patent: Mar. 13, 2018

(54) AIR-CONDITIONING APPARATUS INCLUDING HEAT EXCHANGER WITH CONTROLLED HEAT EXCHANGE AMOUNT

(75) Inventors: Tadashi Ariyama, Tokyo (JP); Kosuke Tanaka, Tokyo (JP); Hirofumi Koge, Tokyo (JP); Hiroyuki Okano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 348 days.

(21) Appl. No.: 14/385,555

(22) PCT Filed: Mar. 29, 2012

(86) PCT No.: PCT/JP2012/002173

§ 371 (c)(1),
(2), (4) Date: Sep. 16, 2014

(87) PCT Pub. No.: WO2013/145006

PCT Pub. Date: Oct. 3, 2013

(65) Prior Publication Data

US 2015/0040597 A1 Feb. 12, 2015

(51) Int. Cl.

| | |
|---|---|
| ***F25B 49/02*** | (2006.01) |
| ***F25B 13/00*** | (2006.01) |
| ***F25B 40/00*** | (2006.01) |
| ***F25B 41/00*** | (2006.01) |
| ***F25D 17/06*** | (2006.01) |
| ***F28D 1/04*** | (2006.01) |

(52) U.S. Cl.

CPC ..... *F25B 49/02* (2013.01); *F25B 13/00* (2013.01); *F25B 40/00* (2013.01); *F25B 41/00* (2013.01);

(Continued)

(58) Field of Classification Search

CPC ..... F25B 2313/0233; F25B 2313/0253; F25B 2313/006; F25B 2313/0231;

(Continued)

(56) References Cited

U.S. PATENT DOCUMENTS 4,984,433 A * 1/1991 Worthington ..... F24F 3/153 62/176.5
6,341,648 B1 * 1/2002 Fukuoka ..... B21C 37/0803 165/101
8,074,459 B2 * 12/2011 Murakami ..... F25B 13/00 62/159

(Continued)

FOREIGN PATENT DOCUMENTS

CA 2298754 A1 8/2001
CN 101986062 A 3/2011

(Continued)

OTHER PUBLICATIONS

Japanese Office Action dated Jun. 9, 2015 in the corresponding JP application No. 2014-506999. ( English translation attached ).

(Continued)

*Primary Examiner* — David Teitelbaum
*Assistant Examiner* — Paul Schwarzenberg
(74) *Attorney, Agent, or Firm* — Posz Law Group, PLC

(57) ABSTRACT

An outdoor heat exchanger includes a fan configured to adjust a heat transfer coefficient ao of the outside of a heat transfer tube through which a refrigerant flows, a bypass passage and flow rate control valve configured to adjust a heat transfer coefficient αi of the inside of the heat transfer tube through which the refrigerant flows, and an on-off valve configured to adjust a heat transfer area A where the refrigerant exchanges heat with a heat medium. A controller controls the heat transfer coefficient αo of the outside of the heat transfer tube, the heat transfer coefficient αi of the inside thereof, and the heat transfer area A to control a heat exchange amount of the outdoor heat exchanger.

3 Claims, 4 Drawing Sheets

(52) U.S. Cl.
CPC ..... *F25D 17/06* (2013.01); *F28D 1/0443* (2013.01); *F25B 2313/006* (2013.01); *F25B 2313/0231* (2013.01); *F25B 2313/0233* (2013.01); *F25B 2313/0253* (2013.01); *F25B 2313/0272* (2013.01); *F25B 2313/0294* (2013.01); *F25B 2400/13* (2013.01); *F25B 2400/23* (2013.01); *F25B 2500/09* (2013.01)

(58) Field of Classification Search
CPC ..... F25B 2313/0272; F25B 2313/0294; F25B 2500/09; F25B 17/06; F25B 2600/2515; F28D 1/0443
See application file for complete search history.

(56) References Cited

U.S. PATENT DOCUMENTS

| | | | | |
|---|---|---|---|---|
| 2004/0216477 | A1* | 11/2004 | Yamasaki | F25B 1/10 62/216 |
| 2010/0282434 | A1* | 11/2010 | Yabuuchi | F24D 11/0235 165/63 |

FOREIGN PATENT DOCUMENTS

| | | | |
|---|---|---|---|
| CN | 102003822 | A | 4/2011 |
| EP | 1477748 | A1 | 11/2004 |
| JP | 04-006372 | A | 1/1992 |
| JP | 06-265231 | A | 9/1994 |
| JP | 2006-170608 | A | 6/2006 |
| JP | 2010-009105 | A | 1/2010 |
| WO | 2009122476 | A1 | 10/2009 |

OTHER PUBLICATIONS

Extended European Search Report dated Dec. 4, 2015 in the Corresponding EP application No. 128729225.
International Search Report of the International Searching Authority dated May 22, 2012 for the corresponding international application No. PCT/JP2012/002173 (and English translation).
Office Action dated Jul. 12, 2016 issued in corresponding JP patent application No. 2014-506999 (and English translation).

* cited by examiner

COOLING MAIN OPERATION

AIR-CONDITIONING APPARATUS INCLUDING HEAT EXCHANGER WITH CONTROLLED HEAT EXCHANGE AMOUNT

CROSS REFERENCE TO RELATED APPLICATION

This application is a U.S. national stage application of International Application No. PCT/JP2012/002173 filed on Mar. 29, 2012, the disclosure of which is incorporated by reference.

TECHNICAL FIELD

The present invention relates to an air-conditioning apparatus including a refrigerant circuit through which a refrigerant is circulated.

BACKGROUND ART

For conventional-art air-conditioning apparatuses, a heat exchanger has been recently developed which has a segmented structure such that the heat exchanger includes a plurality of heat exchanger segments. This heat exchanger has a circuit configuration in which each heat exchanger segment is connected to a connecting pipe provided with a solenoid valve. Controlling opening and closing of each solenoid valve controls the flow rate of a refrigerant into the corresponding heat exchanger segment, thus controlling the amount of heat exchanged (hereinafter, referred to as "heat exchange amount") in the heat exchanger (see, for example, Patent Literature 1).

A heat exchanger has also been recently developed which includes flow rate changing means for changing a refrigerant passage in the heat exchanger so that a cooling or heating capacity is appropriately controlled depending on a variable external load (see, for example, Patent Literature 2).

CITATION LIST

Patent Literature

Patent Literature 1: International Publication No. WO 2009/122476

Patent Literature 2: Japanese Unexamined Patent Application Publication No. 2006-170608

SUMMARY OF INVENTION

Technical Problem

According to a technique disclosed in Patent Literature 1, a flow pattern of the refrigerant flowing into the heat exchanger segments is changed to control the area of heat transfer (hereinafter, referred to as the "heat transfer area") and the rate of air flow (hereinafter, "air flow rate") through a fan is controlled to control the coefficient of heat transfer (hereinafter, "heat transfer coefficient") of the outside of a heat transfer tube, thus controlling the heat exchange amount of the heat exchanger.

If the flow rate of the refrigerant through the heat exchanger is reduced, a variation in heat exchange amount will be reduced in the control of the heat transfer coefficient of the outside of the heat transfer tube based on the control of the air flow rate of air blown by the fan, leading to an increased change in heat exchange amount upon changing a heat exchange segmentation pattern. Disadvantageously, an intended heat exchange amount will fail to be achieved.

For example, assuming that a lower limit air flow rate of air blown by the fan is set and the fan is operating at the lower limit air flow rate, if the heat exchange amount is excessively increased due to, for example, the effect of wind or rain from the outside of an apparatus, the heat exchange amount will fail to be reduced by controlling the air flow rate of air blown by the fan.

According to a technique disclosed in Patent Literature 2, the flow rate changing means changes the refrigerant passage in the heat exchanger to cause a stepwise change in heat transfer area of the inside of a heat transfer tube, thus controlling the heat exchange amount.

Such a method of changing only the heat transfer area of the inside of the heat transfer tube requires many changing means if the heat exchange amount has to be continuously controlled. Unfortunately, this results in an increased cost and a complicated shape of the heat exchanger.

The present invention has been made to overcome the above-described disadvantages and provides an air-conditioning apparatus capable of controlling the heat exchange amount of a heat exchanger to an intended value.

If the flow rate of a refrigerant flowing through the heat exchanger is reduced and a variation in heat exchange amount caused by control of the heat transfer coefficient of the outside of a heat transfer tube is accordingly reduced, the air-conditioning apparatus according to the present invention can continuously control the heat exchange amount of the heat exchanger.

Solution to Problem

The present invention provides an air-conditioning apparatus including a refrigerant circuit through which a refrigerant is circulated, the refrigerant circuit including at least a compressor, expansion means, and a heat exchanger, and further including controller configured to control a heat exchange amount of the heat exchanger. The heat exchanger includes tube-outside heat transfer coefficient adjusting means configured to adjust a heat transfer coefficient ($\alpha o$) of an outside of a heat transfer tube through which the refrigerant flows, tube-inside heat transfer coefficient adjusting means configured to adjust a heat transfer coefficient ($\alpha i$) of an inside of the heat transfer tube through which the refrigerant flows, and heat transfer area adjusting means configured to adjust a heat transfer area (A) where the refrigerant exchanges heat with a heat medium. The controller controls the heat transfer coefficient ($\alpha o$) of the outside of the heat transfer tube, the heat transfer coefficient ($\alpha i$) of the inside of the heat transfer tube, and the heat transfer area (A) to control the heat exchange amount of the heat exchanger.

Advantageous Effects of Invention

According to the present invention, the heat transfer coefficient ($\alpha o$) of the outside of the heat transfer tube, the heat transfer coefficient ($\alpha i$) of the inside of the heat transfer tube, and the heat transfer area (A) are controlled, so that the heat exchange amount of the heat exchanger can be controlled to an intended value.

DESCRIPTION OF EMBODIMENTS

Embodiments of the present invention will now be described with reference to the drawings.

Embodiment 1

Figure 1:
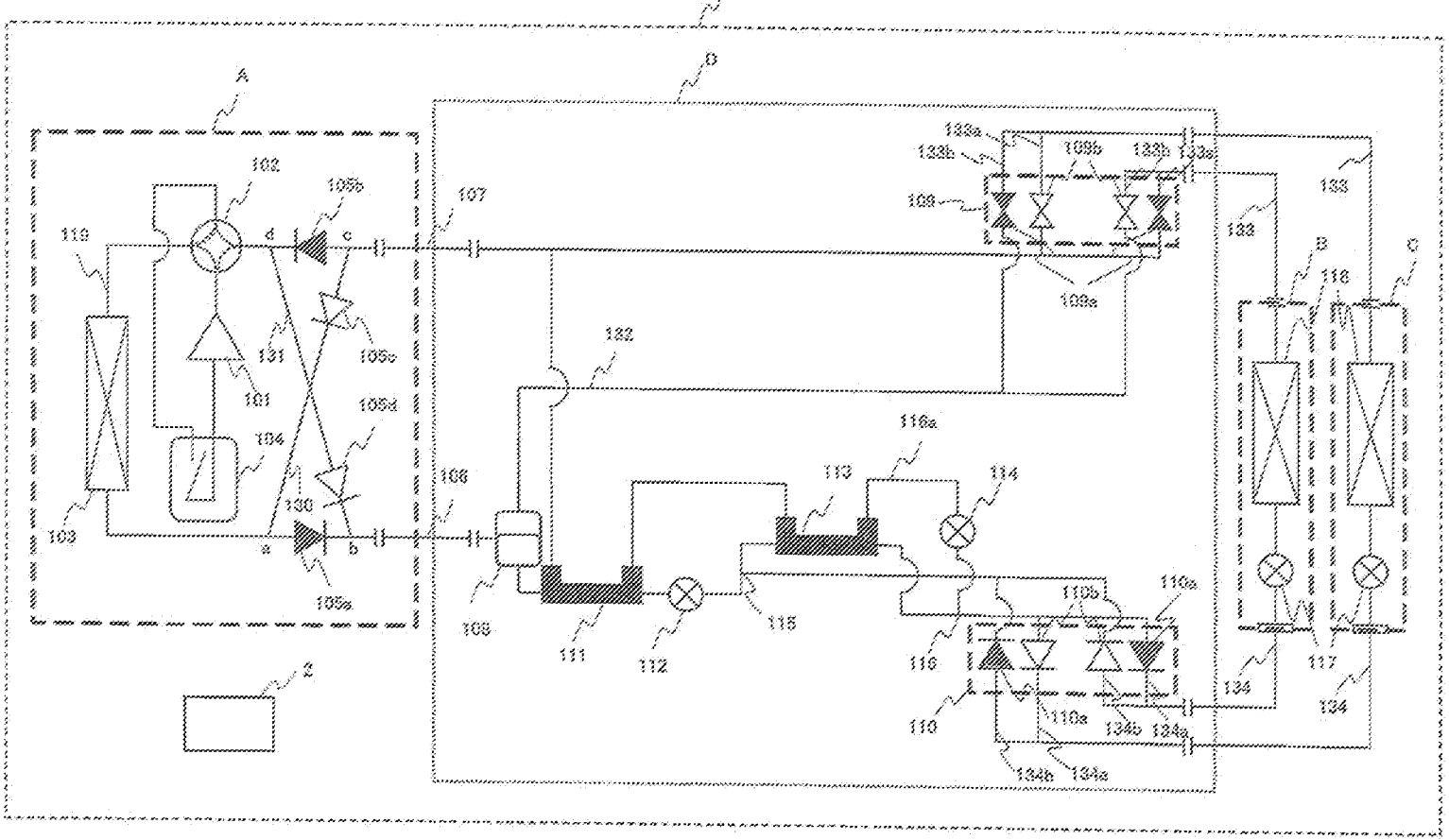
FIG. 1 is a refrigerant circuit diagram illustrating the configuration of a refrigerant circuit of an air-conditioning apparatus according to Embodiment 1 in a cooling main operation.

FIG. 1 is a refrigerant circuit diagram illustrating the configuration of a refrigerant circuit of an air-conditioning apparatus according to Embodiment 1 in a cooling main operation. The configuration of the refrigerant circuit of the air-conditioning apparatus will be described with reference to FIG. 1. This air-conditioning apparatus is installed in a building, a condominium, or the like and is capable of supplying to a cooling load and a heating load at the same time using a refrigeration cycle (heat pump cycle) through which a refrigerant (air-conditioning refrigerant) is circulated. The cooling main operation of an air-conditioning refrigeration cycle 1 will be described with reference to FIG. 1. Note that the dimensional relationship among components in FIG. 1 and subsequent figures may be different from the actual ones.

[Air-Conditioning Refrigeration Cycle 1]

The air-conditioning refrigeration cycle 1 includes a heat source unit A, a cooling indoor unit B that deals with the cooling load, a heating indoor unit C that deals with the heating load, and a relay unit D. The cooling indoor unit B and the heating indoor unit C are arranged such that these units are connected in parallel with the heat source unit A. The relay unit D, disposed between the heat source unit A and each of the cooling indoor unit B and the heating indoor unit C, switches flow of the refrigerant between different directions, thus allowing each of the cooling indoor unit B and the heating indoor unit C to fulfill its function. A controller 2 controls an operation of the air-conditioning refrigeration cycle 1 in a centralized manner.

[Heat Source Unit A]

The heat source unit A includes an air-conditioning compressor 101, a four-way valve 102 that serves as flow switching means, an outdoor heat exchanger 103, and an accumulator 104 which are connected in series by connecting pipes 119. The heat source unit A has a function for supplying cooling energy to the cooling indoor unit B and the heating indoor unit C. A blower device, such as a fan, to supply air (heat medium) to the outdoor heat exchanger 103 may be disposed in the vicinity of the outdoor heat exchanger 103.

A high-pressure side connecting pipe 106 and a low-pressure side connecting pipe 107 are connected by a first connecting pipe 130 and a second connecting pipe 131. The first connecting pipe 130 connects an upstream side of a check valve 105*a* to an upstream side of a check valve 105*b*. The second connecting pipe 131 connects a downstream side of the check valve 105*a* to a downstream side of the check valve 105*b*. In other words, a connection point a between the high-pressure side connecting pipe 106 and the first connecting pipe 130 is upstream of a connection point b between the high-pressure side connecting pipe 106 and the second connecting pipe 131 such that the check valve 105*a* is disposed between the connection points a and b. A connection point c between the low-pressure side connecting pipe 107 and the first connecting pipe 130 is in the upstream of a connection point d between the low-pressure side connecting pipe 107 and the second connecting pipe 131 such that the check valve 105*b* is disposed between the connection points c and d.

The first connecting pipe 130 is provided with a check valve 105*c* which permits the air-conditioning refrigerant to flow only in a direction from the low-pressure side connecting pipe 107 to the high-pressure side connecting pipe 106. The second connecting pipe 131 is provided with a check valve 105*d* which permits the air-conditioning refrigerant to flow only in the direction from the low-pressure side connecting pipe 107 to the high-pressure side connecting pipe 106. In FIG. 1, which illustrates the configuration of the refrigerant circuit in the cooling main operation, the check valves 105*a* and 105*b* are in an opened state (indicated by solid marks) and the check valves 105*c* and 105*d* are in a closed state (indicated by open marks).

The air-conditioning compressor 101 sucks the air-conditioning refrigerant and compresses the air-conditioning refrigerant into a high-temperature high-pressure state. The four-way valve 102 switches the flow of the air-conditioning refrigerant between different directions. The outdoor heat exchanger 103, functioning as an evaporator or a radiator (condenser), exchanges heat between air supplied from the blower device (not illustrated) and the air-conditioning refrigerant so that the air-conditioning refrigerant evaporates and gasifies or condenses and liquefies. The outdoor heat exchanger 103 is, for example, a cross-fin type fin-and-tube heat exchanger including a heat transfer tube and many fins. The accumulator 104, which is disposed between the four-way valve 102 and the air-conditioning compressor 101, stores an excess of the air-conditioning refrigerant. The accumulator 104 may be any container capable of storing an excess of air-conditioning refrigerant.

[Cooling Indoor Unit B and Heating Indoor Unit C]

The cooling indoor unit B and the heating indoor unit C each include air-conditioning expansion means 117 and an indoor heat exchanger 118 connected in series. As illustrated as an example, two air-conditioning expansion means 117 and two indoor heat exchangers 118 are arranged in parallel in the cooling indoor unit B and the heating indoor unit C. The cooling indoor unit B has a function for receiving cooling energy from the heat source unit A to deal with a cooling load. The heating indoor unit C has a function for receiving cooling energy from the heat source unit A to deal with a heating load.

Specifically, Embodiment 1 illustrates a state in which the relay unit D determines the cooling indoor unit B to deal with the cooling load and determines the heating indoor unit C to deal with the heating load. An blower device, such as a fan, to supply air (heat medium) to the indoor heat exchanger 118 may be disposed in the vicinity of each of the indoor heat exchangers 118. For the sake of convenience, connecting pipes which connect the relay unit D to the indoor heat exchangers 118 will be referred to as "connecting pipes 133" and connecting pipes which connect the relay unit D to the air-conditioning expansion means 117 will be referred to as "connecting pipes 134".

Each air-conditioning expansion means 117, functioning as a pressure reducing valve or an expansion valve, reduces the pressure of the air-conditioning refrigerant so as to expand the refrigerant. The air-conditioning expansion means 117 may be a component having a variably controllable opening degree, for example, accurate flow controller, such as an electronic expansion valve, or inexpensive refrigerant flow controller, such as a capillary tube. Each indoor heat exchanger 118, functioning as a radiator (condenser) or an evaporator, exchanges heat between air supplied from the blower device (not illustrated) and the air-conditioning refrigerant so that the air-conditioning refrigerant condenses and liquefies or evaporates and gasifies. The indoor heat exchanger 118 may be, for example, a cross fin type fin-and-tube heat exchanger including a heat transfer tube and many fins. The air-conditioning expansion means 117 and the indoor heat exchanger 118 are connected in series.

[Relay Unit D]

The relay unit D has a function for connecting each of the cooling indoor unit B and the heating indoor unit C to the heat source unit A. The relay unit D further has a function for selectively opening either of valve means 109*a* and valve means 109*b* of a first distribution section 109 and closing the other means to determine whether the corresponding indoor heat exchanger 118 functions as a radiator or an evaporator. The relay unit D includes a gas-liquid separator 108, the first distribution section 109, a second distribution section 110, a first internal heat exchanger 111, first relay-unit expansion means 112, a second internal heat exchanger 113, and second relay-unit expansion means 114.

In the first distribution section 109, each connecting pipe 133 branches into two parts. A connecting pipe 133*a*, serving as one of the two parts, connects to the low-pressure side connecting pipe 107. A connecting pipe 133*b*, serving as the other one, connects to a connecting pipe 132 which connects to the gas-liquid separator 108. The connecting pipe 133*a* is provided with the valve means 109*a* whose opening and closing is controlled to permit or stop flow of the refrigerant. The connecting pipe 133*b* is provided with the valve means 109*b* whose opening and closing is controlled to permit or stop flow of the refrigerant. Opened and closed states of the valve means 109*a* and 109*b* are indicated by solid marks (opened state) and open marks (closed state).

In the second distribution section 110, each connecting pipe 134 branches into two parts. A connecting pipe 134*b*, serving as one of the two parts, is connected to a first flow merging portion 115. A connecting pipe 134*a*, serving as the other one, is connected to a second flow merging portion 116. The connecting pipe 134*a* is provided with a check valve 110*a* that permits the refrigerant to flow only in one direction. The connecting pipe 134*b* is provided with a check valve 110*b* that permits the refrigerant to flow only in one direction. Opened and closed states of the check valves 110*a* and 110*b* are indicated by a solid mark (opened state) and an open mark (closed state).

The first flow merging portion 115 is connected to the second distribution section 110 and is also connected through the first relay-unit expansion means 112 and the first internal heat exchanger 111 to the gas-liquid separator 108. The second flow merging portion 116 branches into two parts between the second distribution section 110 and the second internal heat exchanger 113. One of the two parts is connected through the second internal heat exchanger 113 to the first flow merging portion 115 disposed between the second distribution section 110 and the first relay-unit expansion means 112. The other part (a second flow merging part 116*a*) is connected through the second relay-unit expansion means 114, the second internal heat exchanger 113, and the first internal heat exchanger 111 to the low-pressure side connecting pipe 107.

The gas-liquid separator 108 separates the air-conditioning refrigerant into a gas refrigerant and a liquid refrigerant. The gas-liquid separator 108 is provided for the high-pressure side connecting pipe 106. One end of the gas-liquid separator 108 is connected to each valve means 109*a* of the first distribution section 109 and the other end thereof is connected through the first flow merging portion 115 to the second distribution section 110. The first distribution section 109 has a function for selectively opening either of the valve means 109*a* and the valve means 109*b* and closing the other means in order to allow the air-conditioning refrigerant to flow to the indoor heat exchanger 118. The second distribution section 110 has a function for permitting the air-conditioning refrigerant to flow through either one of the check valves 110*a* and 110*b*.

The first internal heat exchanger 111 is provided for the first flow merging portion 115 disposed between the gas-liquid separator 108 and the first relay-unit expansion means 112. The first internal heat exchanger 111 exchanges heat between the air-conditioning refrigerant flowing through the first flow merging portion 115 and the air-conditioning refrigerant flowing through the second flow merging part 116*a* extending from the second flow merging portion 116. The first relay-unit expansion means 112 is provided for the first flow merging portion 115 disposed between the first internal heat exchanger 111 and the second distribution section 110. The first relay-unit expansion means 112 reduces the pressure of the air-conditioning refrigerant so as to expand the refrigerant. The first relay-unit expansion means 112 may be a component having a variably controllable opening degree, for example, accurate flow controller, such as an electronic expansion valve, or inexpensive refrigerant flow controller, such as a capillary tube.

The second internal heat exchanger 113, which is provided for the second flow merging portion 116, exchanges heat between the air-conditioning refrigerant flowing through the second flow merging portion 116 and the air-conditioning refrigerant flowing through the second flow merging part 116*a* extending from the second flow merging portion 116. The second relay-unit expansion means 114 is provided for the second flow merging portion 116 disposed between the second internal heat exchanger 113 and the second distribution section 110. The second relay-unit expansion means 114, functioning as a pressure reducing valve or an expansion valve, reduces the pressure of the refrigerant so as to expand the refrigerant. Like the first relay-unit expansion means 112, the second relay-unit expansion means 114 may be a component having a variably controllable opening degree, for example, accurate flow controller, such as an electronic expansion valve, or inexpensive refrigerant flow controller, such as a capillary tube.

As described above, the air-conditioning refrigeration cycle 1 is configured such that the air-conditioning compressor 101, the four-way valve 102, each indoor heat exchanger 118, each air-conditioning expansion means 117, and the outdoor heat exchanger 103 are connected in series and the two indoor heat exchangers 118 are connected in parallel through the relay unit D with the air-conditioning compressor 101, the four-way valve 102, and the outdoor heat exchanger 103 connected in series to establish first refrigerant circuits through which the air-conditioning refrigerant is circulated.

The air-conditioning compressor 101 may be of any type capable of compressing a sucked refrigerant into a high pressure state. For example, the air-conditioning compressor 101 may be any of various types, such as reciprocal, rotary, scroll, and screw compressors. This air-conditioning compressor 101 may be of a type whose rotation speed can be variably controlled by an inverter or may be of a type whose rotation speed is fixed. The refrigerant circulated through the air-conditioning refrigeration cycle 1 may be of any type. For example, any of a natural refrigerant, such as carbon dioxide ($CO_2$), hydrocarbon, or helium, a chlorine-free alternate refrigerant, such as HFC410A, HFC407C, or HFC404A, and a chlorofluorocarbon (CFC) refrigerant, such as R22 or R134a, used in existing products may be used.

Figure 2:
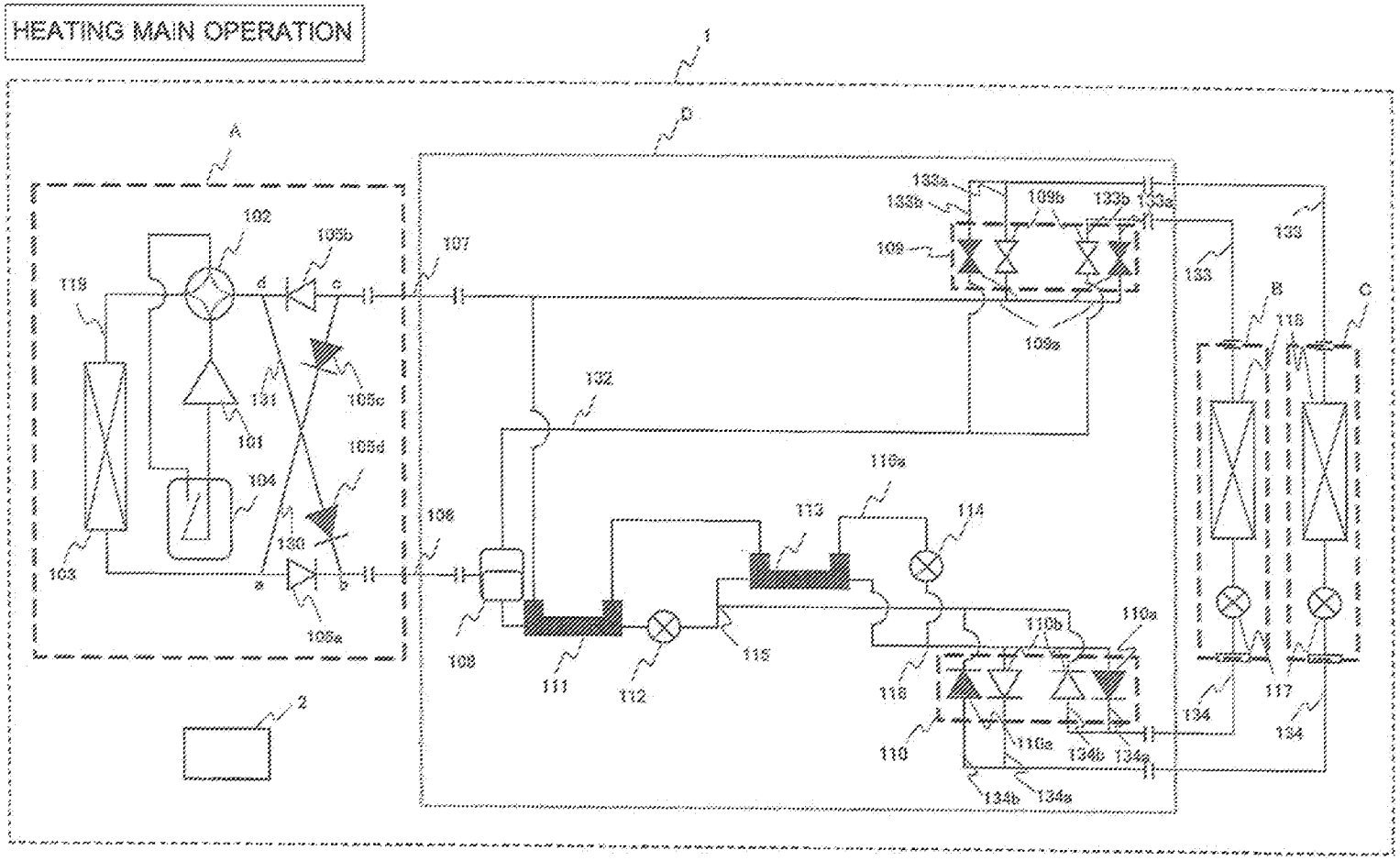
FIG. 2 is a refrigerant circuit diagram illustrating the configuration of the refrigerant circuit of the air-conditioning apparatus according to Embodiment 1 in a heating main operation.

A heating main operation of the air-conditioning refrigeration cycle 1 will now be described with reference to FIG. 2. The air-conditioning refrigerant in a high-temperature high-pressure state compressed by the air-conditioning compressor 101 is discharged from the air-conditioning compressor 101 and passes through the four-way valve 102 and then flows through the check valve 105*d* to the high-pressure side connecting pipe 106. The air-conditioning refrigerant in a superheated gas state flows through the high-pressure side connecting pipe 106 into the gas-liquid separator 108 in the relay unit D. The air-conditioning refrigerant in the superheated gas state, which has flowed into the gas-liquid separator 108, is supplied to the circuit in which the valve means 109*a* in the first distribution section 109 is opened. In this case, the air-conditioning refrigerant in the superheated gas state flows into the heating indoor unit C.

The air-conditioning refrigerant, which has flowed into the heating indoor unit C, transfers heat (namely, heats indoor air) in the indoor heat exchanger 118 and is pressure-reduced by the air-conditioning expansion means 117 and then merges with flow in the first flow merging portion 115. On the other hand, part of the air-conditioning refrigerant in the superheated gas state, which has flowed into the gas-liquid separator 108, exchanges heat with the air-conditioning refrigerant, expanded into a low-temperature low-pressure state by the second relay-unit expansion means 114, in the first internal heat exchanger 111, thus obtaining the degree of subcooling.

Then, the air-conditioning refrigerant passes through the first relay-unit expansion means 112 and merges with the air-conditioning refrigerant which has been used for air conditioning (i.e., the air-conditioning refrigerant which has flowed into the heating indoor unit C and transferred heat in the indoor heat exchanger 118) in the first flow merging portion 115. As regards the part of the air-conditioning refrigerant in the superheated gas state passing through the first relay-unit expansion means 112, the first relay-unit expansion means 112 may be fully closed to stop flow of the refrigerant therethrough. After that, the air-conditioning refrigerant exchanges heat with the air-conditioning refrigerant, expanded into a low-temperature low-pressure state by the second relay-unit expansion means 114, in the second internal heat exchanger 113, thus obtaining the degree of subcooling. This air-conditioning refrigerant is distributed into parts, one part flowing to the second flow merging portion 116, the other part flowing to the second relay-unit expansion means 114.

The air-conditioning refrigerant flowing through the second flow merging portion 116 is supplied to the circuit in which the check valve 110*a* permits flow. In this case, the air-conditioning refrigerant flowing through the second flow merging portion 116 flows into the cooling indoor unit B and is expanded into a low-temperature low-pressure state by the air-conditioning expansion means 117 and evaporates in the indoor heat exchanger 118. The refrigerant passes through the valve means 109*a* and merges with flow in the low-pressure side connecting pipe 107. The air-conditioning refrigerant leaving the second relay-unit expansion means 114 evaporates while exchanging heat in the second internal heat exchanger 113 and the first internal heat exchanger 111 and then merges in the low-pressure side connecting pipe 107 with the flow of the air-conditioning refrigerant leaving the cooling indoor unit B. The air-conditioning refrigerant merging together in the low-pressure side connecting pipe 107 passes through the check valve 105*c* to the outdoor heat exchanger 103, where a liquid refrigerant remaining depending on an operation condition is evaporated. The refrigerant then passes through the four-way valve 102 and the accumulator 104 and returns to the air-conditioning compressor 101.

The amount of heat (or "heat exchange amount") of the refrigerant which has to be evaporated in the outdoor heat exchanger 103 varies depending on the balance of operating loads between the heating indoor unit C and the cooling indoor unit B. Specifically, the heat exchange amount necessary for the outdoor heat exchanger 103 increases as the difference in heat exchange amount between the heating indoor unit C and the cooling indoor unit B increases. To allow both the heating indoor unit C and the cooling indoor unit B to deal with various loads, it is therefore necessary to continuously control the heat exchange amount (or capacity) of the outdoor heat exchanger 103.

The heat transfer characteristic of a heat exchanger will now be described.

Equation 1 is known as a fundamental expression representing the heat transfer characteristic of a heat exchanger.

$$Q=AK\times dT \quad \text{(Equation 1)}$$

In Equation 1, Q denotes the heat exchange amount, AK denotes the thermal conductance of the heat exchanger, and dT denotes the temperature difference between substances that exchange heat therebetween.

Equation 2 is known as a relational expression representing the thermal conductance AK of the heat exchanger.

$$1/AK=1/(A\times\alpha o)+1/(Ai\times\alpha i) \quad \text{(Equation 2)}$$

In Equation 2, A denotes the area of heat transfer of the outside of a tube (hereinafter, referred to as the "tube-outside heat transfer area") of the heat exchanger, Ai denotes the heat transfer area of the inside of the tube (hereinafter, "tube-inside heat transfer area") of the heat exchanger, $\alpha o$ denotes the heat transfer coefficient of the outside of the tube (hereinafter, "tube-outside heat transfer coefficient") of the heat exchanger, and $\alpha i$ denotes the heat transfer coefficient of the inside of the tube (hereinafter, "tube-inside heat transfer coefficient") of the heat exchanger.

The tube-outside heat transfer coefficient $\alpha o$ corresponds to the "heat transfer coefficient ($\alpha o$) of the outside of a heat transfer tube through which the refrigerant flows" in the present invention and the tube-inside heat transfer coefficient $\alpha i$ corresponds to the "heat transfer coefficient ($\alpha i$) of the inside of the heat transfer tube through which the refrigerant flows" in the present invention. The tube-outside heat transfer area Ao and the tube-inside heat transfer area Ai correspond to the "heat transfer area (A) where the refrigerant exchanges heat with the heat medium" in the present invention.

As described in Equation 2, the thermal conductance AK of the heat exchanger is determined by the tube-outside heat transfer area Ao, the tube-inside heat transfer area Ai, the tube-outside heat transfer coefficient $\alpha o$, and the tube-inside heat transfer coefficient αi. Controlling this value can control the heat exchange amount (processing capacity) of the heat exchanger.

Equation 2 implies that a smaller one of the product of the tube-outside heat transfer area Ao and the tube-outside heat transfer coefficient αo of the heat exchanger and the product of the tube-inside heat transfer area Ai and the tube-inside heat transfer coefficient αi dominantly affects the thermal conductance AK of the heat exchanger.

Accordingly, merely controlling either the tube-outside heat transfer coefficient αo or the tube-inside heat transfer coefficient αi may fail to achieve an intended heat exchange amount (processing capacity) because when the heat transfer coefficient which is not controlled is dominant, controlling the heat transfer coefficient which is controlled provides a small effect of changing the thermal conductance AK.

In terms of practical use, each of means (which will be described later) for controlling the tube-inside heat transfer coefficient αi and the tube-outside heat transfer coefficient αo can control a control amount in a limited range (extent). Accordingly, both the tube-inside heat transfer coefficient αi and the tube-outside heat transfer coefficient αo have to be controlled in order to deal with the effect of loads, disturbance, or the like.

The tube-outside heat transfer area Ao and the tube-inside heat transfer area Ai are determined by the shape of the heat exchanger and a refrigerant passage in the heat exchanger. Specifically, one heat exchanger is segmented into a plurality of heat exchanger segments having different refrigerant passages. The tube-outside heat transfer area Ao and the tube-inside heat transfer area Ai can be controlled in a stepwise manner by permitting or stopping flow of the refrigerant through each passage. The tube-outside heat transfer area Ao and the tube-inside heat transfer area Ai change together in accordance with the permitted or stopped flow of the refrigerant through each passage. If constant flow of the refrigerant through each passage is provided, the tube-outside heat transfer area Ao and the tube-inside heat transfer area Ai are constant. In the following description, the tube-outside heat transfer area Ao and the tube-inside heat transfer area Ai to be controlled will be collectively referred to as the "heat transfer area A" of the heat exchanger.

Controlling the heat transfer area A of the heat exchanger can reduce the effect of loads or disturbance. The heat exchange amount can be controlled in a wider range than a case where the heat transfer area A is not controlled.

As described above, controlling the tube-inside heat transfer coefficient αi, the tube-outside heat transfer coefficient αo, and the heat transfer area A can control the heat exchange amount of the heat exchanger if either the tube-outside heat transfer coefficient αo or the tube-inside heat transfer coefficient αi becomes dominant due to a load fluctuation or disturbance. If the tube-inside heat transfer coefficient αi and the tube-outside heat transfer coefficient αo, serving as control amounts, are controlled in the same range, the heat exchange amount can be controlled in a wider range than that in the case where the heat transfer area A is not controlled.

A configuration and operation for controlling the tube-inside heat transfer coefficient αi, the tube-outside heat transfer coefficient αo, and the heat transfer area A of the outdoor heat exchanger 103 in the air-conditioning apparatus according to Embodiment 1 will now be described.

In Embodiment 1, a circuit capable of supplying to a cooling load and a heating load at the same time will be described as an example of the air-conditioning apparatus in which the heat exchange amount of the outdoor heat exchanger 103 has to be controlled. Any refrigerant circuit with control for the heat exchange amount of a heat exchanger may be used. The refrigerant circuit may be a refrigerant circuit which includes at least a compressor, a heat exchanger functioning as a condenser, expansion means, and a heat exchanger functioning as an evaporator and through which a refrigerant is circulated. The heat exchange amount of any of the heat exchangers in this refrigerant circuit may be controlled. Furthermore, the refrigerant circuit may be a refrigerant circuit of a typical air-conditioning apparatus capable of switching between cooling and heating or a refrigerant circuit of an air-conditioning apparatus intended only for cooling or heating.

Figure 3:
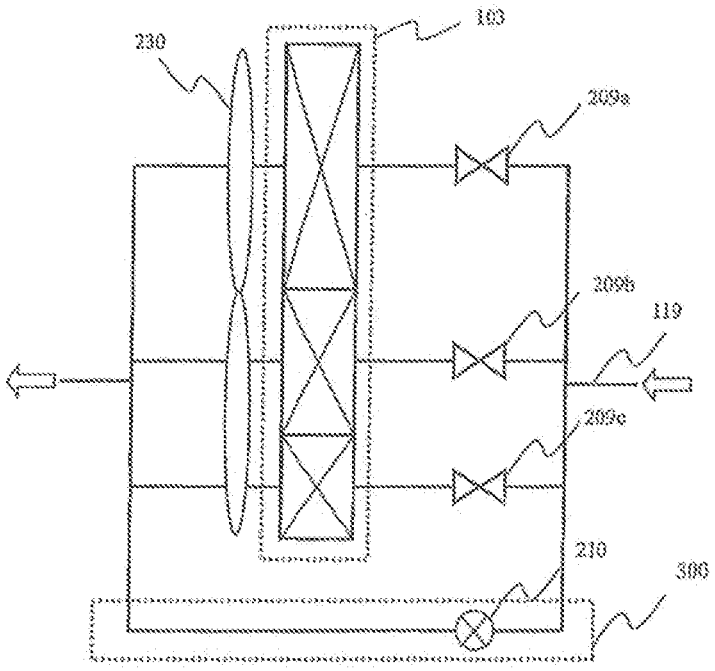
FIG. 3 is a diagram explaining the structure of an outdoor heat exchanger in Embodiment 1.

FIG. 3 is a diagram explaining the structure of the outdoor heat exchanger in Embodiment 1.

FIG. 3 illustrates a case where the outdoor heat exchanger 103 has a segmented structure in which the outdoor heat exchanger 103 includes a plurality of heat exchangers (hereinafter, referred to as "heat exchanger segments") having different refrigerant passages.

The outdoor heat exchanger 103 may have a segmented structure including four heat exchangers or may have a segmented structure including four heat exchanger segments that constitute a single heat exchanger.

The outdoor heat exchanger 103 may have any number of heat exchanger segments. The number of heat exchanger segments varies depending on control ranges of controllers for the tube-outside heat transfer coefficient αo and the tube-inside heat transfer coefficient αi.

As illustrated in FIG. 3, the connecting pipe 119 branches into a plurality of pipes which are connected to the respective heat exchanger segments constituting the outdoor heat exchanger 103. The connecting pipes 119, serving as branch pipes, are provided with solenoid valves 209*a*, 209*b*, and 209*c*, each serving as an on-off valve whose opening and closing is controlled through the controller 2 to permit or stop flow of the refrigerant through the valve.

The solenoid valves 209*a*, 209*b*, and 209*c* are included in "heat transfer area adjusting means" in the present invention.

One of the connecting pipes 119, serving as branch pipes, is included in a bypass 300 that bypasses the heat exchanger segments. This bypass 300 is provided with an expansion valve 210, serving as flow controller configured to control the rate of flow through the bypass 300.

The bypass 300 and the expansion valve 210 are included in "tube-inside heat transfer coefficient adjusting means" in the present invention.

The outdoor heat exchanger 103 is provided with a fan 230 to control the rate of air flow through the outdoor heat exchanger 103.

The fan 230 is included in "tube-outside heat transfer coefficient adjusting means" in the present invention.

Although FIG. 3 illustrates the heat exchanger in which the air flow rate is controlled by the fan 230 as means for controlling the tube-outside heat transfer coefficient αo, the present invention should not be limited to this example. For example, in a plate heat exchanger that exchanges heat between a refrigerant and water, a pump to control the rate of water flow functions as tube-outside heat transfer coefficient adjusting means configured to adjust the tube-outside heat transfer coefficient αo.

A heat exchange amount control operation of the outdoor heat exchanger 103 will now be described.

Figure 4:
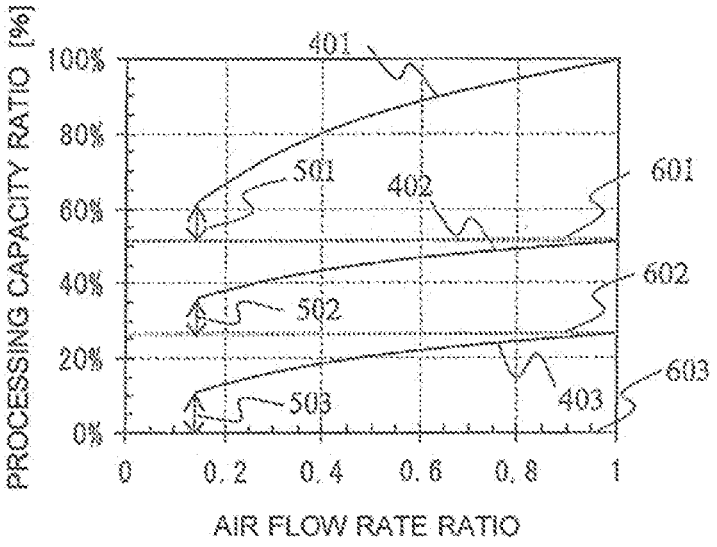
FIG. 4 is a diagram explaining a change in processing capacity of the heat exchanger in Embodiment 1.

FIG. 4 is a diagram explaining a change in processing capacity of the heat exchanger in Embodiment 1.

Figure 5:
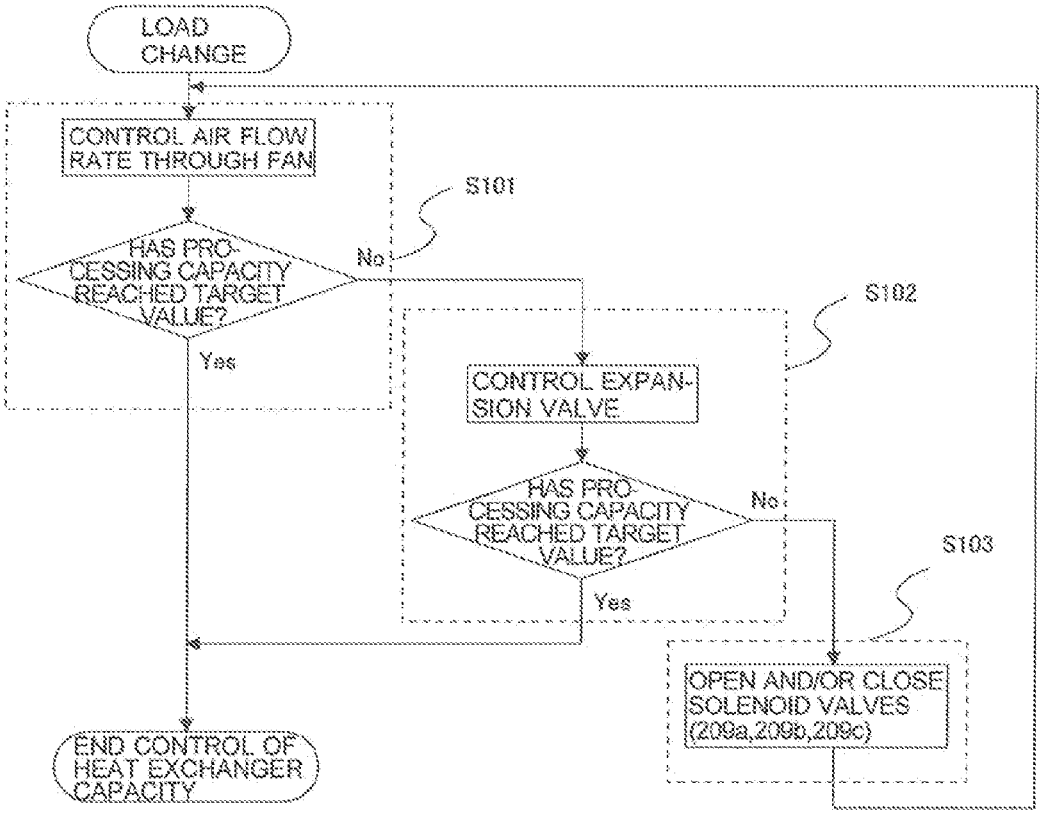
FIG. 5 is a flowchart illustrating a process of controlling a heat exchange amount in Embodiment 1.

FIG. 5 is a flowchart illustrating a process of controlling the heat exchange amount in Embodiment 1.

In FIG. 4, the axis of ordinates indicates the processing capacity ratio. When the processing capacity ratio is 100%, the cooling indoor unit B has no load and only the outdoor heat exchanger 103 allows evaporation of the refrigerant.

When the processing capacity ratio is 0%, the cooling indoor unit B has a high load and the outdoor heat exchanger 103 has no load. The axis of abscissas indicates the air flow rate ratio. When the air flow rate ratio is 100%, the fan 230 is operating at a maximum air flow rate. When the air flow rate ratio is 0%, the fan 230 is stopped. The air flow rate of air blown by the fan 230 has a lower limit. The lower limit air flow rate is set in order to ensure heat radiation from a heat generating element, such as a plated circuit, disposed within the heat source unit A.

The flowchart of FIG. 5 will now be described with reference to FIG. 4.

In the above-described operation, when the operating load of the heating indoor unit C and that of the cooling indoor unit B fluctuate and a processing capacity (target processing capacity) necessary for the outdoor heat exchanger 103 accordingly changes, the operation for controlling the heat exchange amount to the target processing capacity is started.

(S101)

The controller 2 controls the air flow rate of air blown by the fan 230 to control the tube-outside heat transfer coefficient $\alpha o$. Specifically, when reducing the heat exchange amount of the outdoor heat exchanger 103, the controller 2 reduces the air flow rate of air blown by the fan 230 to reduce the tube-outside heat transfer coefficient $\alpha o$. When increasing the heat exchange amount of the outdoor heat exchanger 103, the controller 2 increases the air flow rate of air blown by the fan 230 to increase the tube-outside heat transfer coefficient $\alpha o$.

This control allows the processing capacity (heat exchange amount) of the outdoor heat exchanger 103 to change depending on the air flow rate of air blown by the fan 230, as indicated by a processing capacity line 401, 402, or 403 in FIG. 4.

The processing capacity line 401 indicates a case where all of the solenoid valves 209*a*, 209*b*, and 209*c* are in an opened state. The processing capacity line 402 indicates a case where the solenoid valve 209*a* is in a closed state and the solenoid valves 209*b* and 209*c* are in the opened state. The processing capacity line 403 indicates a case where the solenoid valves 209*a* and 209*b* are in the closed state and the solenoid valve 209*c* is in the opened state. Control of the solenoid valves will be described later.

The controller 2 determines whether the processing capacity (heat exchange amount) of the outdoor heat exchanger 103 has reached the target value.

This determination, for example, in the heating main operation may be made based on whether a pressure at a suction inlet of the air-conditioning compressor 101 has reached a predetermined value. The determination in the cooling main operation may be made based on whether a pressure at a discharge outlet of the air-conditioning compressor 101 has reached a predetermined value.

When the processing capacity (heat exchange amount) of the outdoor heat exchanger 103 has reached the target value, the controller 2 terminates the heat exchange amount control operation. On the other hand, if the target processing capacity is not achieved by controlling the air flow rate of air blown by the fan 230 in a range from the lower limit air flow rate to the maximum air flow rate, the process proceeds to step S102.

(S102)

The controller 2 controls the opening degree of the expansion valve 210 to control the rate of the refrigerant flowing through the bypass 300, thus controlling the tube-inside heat transfer coefficient $\alpha i$. Specifically, when reducing the heat exchange amount of the outdoor heat exchanger 103, the controller 2 increases the opening degree of the expansion valve 210 to increase the flow rate through the bypass 300, thus reducing the velocity of the refrigerant flowing through the outdoor heat exchanger 103 to reduce the tube-inside heat transfer coefficient $\alpha i$. When increasing the heat exchange amount of the outdoor heat exchanger 103, the controller 2 reduces the opening degree of the expansion valve 210 to reduce the flow rate through the bypass 300, thus increasing the velocity of the refrigerant flowing through the outdoor heat exchanger 103 to increase the tube-inside heat transfer coefficient $\alpha i$.

This control allows the processing capacity (heat exchange amount) of the outdoor heat exchanger 103 to change depending on the flow rate through the bypass 300, as indicated by a processing capacity line 501, 502, or 503 in FIG. 4.

The processing capacity line 501 indicates a case where all of the solenoid valves 209*a*, 209*b*, and 209*c* are in the opened state. The processing capacity line 502 indicates a case where the solenoid valve 209*a* is in the closed state and the solenoid valves 209*b* and 209*c* are in the opened state. The processing capacity line 503 indicates a case where the solenoid valves 209*a* and 209*b* are in the closed state and the solenoid valve 209*c* is in the opened state. Control of the solenoid valves will be described later.

The controller 2 determines whether the processing capacity (heat exchange amount) of the outdoor heat exchanger 103 has reached the target value.

When the processing capacity (heat exchange amount) of the outdoor heat exchanger 103 has reached the target value, the controller 2 terminates the heat exchange amount control operation. On the other hand, if the target processing capacity is not achieved by controlling the opening degree of the expansion valve 210 in a range from a fully opened state to a fully closed state, the process proceeds to step S103.

(S103)

The controller 2 controls opening and closing of each of the solenoid valves 209*a*, 209*b*, and 209*c* to permit or stop flow of the refrigerant through the corresponding one of the heat exchanger segments, thus controlling the heat transfer area A of the heat exchanger. Specifically, when reducing the heat exchange amount of the outdoor heat exchanger 103, the controller 2 reduces the number of opened solenoid valves of the solenoid valves 209*a*, 209*b*, and 209*c* to reduce the number of heat exchanger segments through which the refrigerant flows, thus reducing the heat transfer area A. When increasing the heat exchange amount of the outdoor heat exchanger 103, the controller 2 increases the number of opened solenoid valves of the solenoid valves 209*a*, 209*b*, and 209*c* to increase the number of heat exchanger segments through which the refrigerant flows, thus increasing the heat transfer area A.

As regards the order to open or close the solenoid valves 209*a*, 209*b*, and 209*c*, for example, to increase the processing capacity (heat exchange amount), the solenoid valves 209*c*, 209*b*, and 209*a* are opened in that order. To reduce the processing capacity (heat exchange amount), the solenoid valves 209*a*, 209*b*, and 209*c* are closed in that order.

For example, when the above-described steps S101 and S102 are executed while all of the solenoid valves 209*a*, 209*b*, and 209*c* are in the opened state, the processing capacity changes as indicated by the processing capacity lines 401 and 501 in FIG. 4. When step S103 is executed at a boundary line 601 in FIG. 4, the solenoid valve 209*a* is controlled to be the closed state.

When the above-described steps S101 and S102 are executed while the solenoid valve 209*a* is in the closed state and the solenoid valves 209*b* and 209*c* are in the opened state, the processing capacity changes as indicated by the processing capacity lines 402 and 502 in FIG. 4. When step S103 is executed at a boundary line 602 in FIG. 4, the solenoid valve 209*b* is controlled to be the closed state.

When the above-described steps S101 and S102 are executed while the solenoid valves 209*a* and 209*b* are in the closed state and the solenoid valve 209*c* is in the opened state, the processing capacity changes as indicated by the processing capacity lines 403 and 503 in FIG. 4. When step S103 is executed at a boundary line 603 in FIG. 4, the solenoid valve 209*c* is controlled to be the closed state.

Although the operation has been described with respect to the case where control of the tube-outside heat transfer coefficient αo (S101), control of the tube-inside heat transfer coefficient αi (S102), and control of the heat transfer area A (S103) are performed in that order, the present invention should not be limited to this example. Such control steps may be performed in any order.

As described above, since the heat exchange amount of the outdoor heat exchanger 103 is controlled by controlling the tube-outside heat transfer coefficient αo, the tube-inside heat transfer coefficient αi, and the heat transfer area A in Embodiment 1, the heat exchange amount of the outdoor heat exchanger 103 can be controlled to be an intended value.

If the flow rate of the refrigerant through the outdoor heat exchanger 103 decreases and a change in heat exchange amount caused by control of the tube-outside heat transfer coefficient αo accordingly decreases, the heat exchange amount can be continuously controlled.

In addition, the heat exchange amount of the outdoor heat exchanger 103 can be continuously controlled regardless of loads or disturbance.

While a lower limit air flow rate of air blown by the fan 230 is set and the fan 230 is operating at the lower limit air flow rate, if the heat exchange amount is excessively increased due to, for example, the effect of wind or rain from the outside of the apparatus, an intended heat exchange amount can be achieved by controlling the tube-inside heat transfer coefficient αi and the heat transfer area A.

Additionally, controlling the solenoid valves 209*a*, 209*b*, and 209*c* enables the whole of the refrigerant flowing through the outdoor heat exchanger 103 to flow through the bypass. Thus, the processing capacity (heat exchange amount) of the outdoor heat exchanger 103 can be reduced to 0%.

If the tube-inside heat transfer coefficient αi, the tube-outside heat transfer coefficient αo, and the heat transfer area A each have a narrow controllable range, the heat exchange amount of the outdoor heat exchanger 103 can be controlled in a wider range than conventional-art control of only the tube-outside heat transfer coefficient αo or the heat transfer area A.

Although the case where the bypass 300 is provided with the expansion valve 210 has been described above, the present invention should not be limited to this example. The outdoor heat exchanger has only to be configured such that the flow rate through the bypass 300 can be controlled. An exemplary configuration will be described with reference to FIG. 6.

Figure 6:
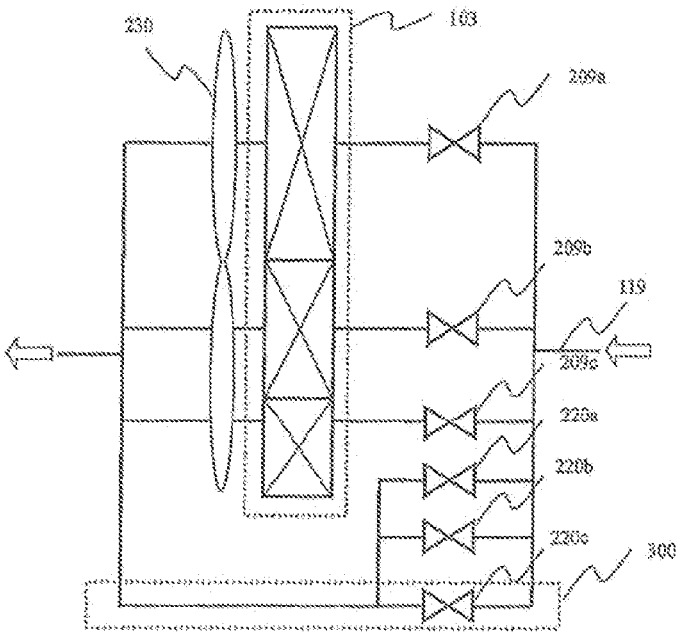
FIG. 6 is a diagram explaining the structure of an outdoor heat exchanger that controls a flow rate with solenoid valves.

FIG. 6 is a diagram explaining the structure of an outdoor heat exchanger in which the flow rate is controlled with solenoid valves.

Referring to FIG. 6, the connecting pipe 119 to be connected to the bypass 300 branches into a plurality of pipes and the pipes are provided with solenoid valves 220*a*, 220*b*, and 220*c* which are independently controlled. The solenoid valves 220*a*, 220*b*, and 220*c* each serve as an on-off valve whose opening and closing is controlled to permit or stop flow of the refrigerant through the valve.

Switching each of the solenoid valves 220*a*, 220*b*, and 220*c* between an opened state and a closed state may change a passage resistance of the bypass 300 to control the flow rate of the refrigerant through the bypass 300, thus controlling the flow rate of the refrigerant through the outdoor heat exchanger 103 to control the tube-inside heat transfer coefficient αi. Consequently, inexpensive solenoid valves can be used as controller configured to control the flow rate through the bypass 300.

Although the control of the heat exchange amount of the outdoor heat exchanger 103 has been described in Embodiment 1, the present invention should not be limited to this example. The heat exchange amount of the indoor heat exchanger 118 can be controlled by application of the above-described technical ideas.

REFERENCE SIGNS LIST

1 air-conditioning refrigeration cycle,
2 controller,
101 air-conditioning compressor,
102 four-way valve,
103 outdoor heat exchanger,
104 accumulator,
105*a* check valve,
105*b* check valve,
105*c* check valve,
105*d* check valve,
106 high-pressure side connecting pipe,
107 low-pressure side connecting pipe,
108 gas-liquid separator,
109 first distribution section,
109*a* valve means,
109*b* valve means,
110 second distribution section,
110*a* check valve,
110*b* check valve,
111 first internal heat exchanger,
112 first relay-unit expansion means,
113 second internal heat exchanger,
114 second relay-unit expansion means,
115 first flow merging portion,
116 second flow merging portion,
116*a* flow merging part,
117 air-conditioning expansion means,
118 indoor heat exchanger,
119 connecting pipe,
130 first connecting pipe,
131 second connecting pipe,
132 connecting pipe,
133 connecting pipe,
133*a* connecting pipe,
133*b* connecting pipe,
134 connecting pipe,
134*a* connecting pipe,
134*b* connecting pipe,
209*a* solenoid valve,

209*b* solenoid valve,
209*c* solenoid valve,
210 expansion valve,
220*a* solenoid valve,
220*b* solenoid valve,
220*c* solenoid valve,
230 fan,
300 bypass,
401 processing capacity line,
402 processing capacity line,
403 processing capacity line,
501 processing capacity line,
502 processing capacity line,
503 processing capacity line,
601 boundary line,
602 boundary line,
603 boundary line
A heat source unit,
B cooling indoor unit,
C heating indoor unit,
D relay unit,
a connection part,
b connection part,
c connection part,
d connection part.

The invention claimed is:

1. An air-conditioning apparatus comprising:

a refrigerant circuit through which a refrigerant is circulated, the refrigerant circuit including at least a compressor, an expansion valve, and a heat exchanger, the heat exchanger exchanging heat between the refrigerant and air; and a controller configured to control a heat exchange amount of the heat exchanger, wherein the heat exchanger comprises a plurality of heat exchanger segments having capacities different from one another, and includes:

a fan configured to blow the air to the heat exchanger to adjust a heat transfer coefficient ($\alpha o$) of an outside of a heat transfer tube through which the refrigerant flows, a bypass passage and a flow rate control valve configured to adjust a heat transfer coefficient ($\alpha i$) of an inside of the heat transfer tube through which the refrigerant flows, the bypass passage allowing part of the refrigerant flowing to the heat exchanger to bypass the heat exchanger and the flow rate control valve controlling a flow rate of a refrigerant flowing through the bypass passage, and an on-off valve disposed in each passage of the plurality of heat exchanger segments and configured to adjust a heat transfer area (A) where the refrigerant exchanges heat with the air, and wherein, for controlling the heat exchange amount of the heat exchanger, the controller is configured to:

determine whether a target processing capacity of the heat exchanger changes, control, in response to a determination that the target processing capacity of the heat exchanger changes, an air flow rate of air blown by the fan to control the heat transfer coefficient ($\alpha o$) of the outside of the heat transfer tube, determine, after controlling the heat transfer coefficient ($\alpha o$) of the outside of the heat transfer tube, whether the processing capacity of the heat exchanger reaches the target processing capacity, control, in response to a determination after controlling the heat transfer coefficient ($\alpha o$) of the outside of the heat transfer tube that the processing capacity of the heat exchanger does not reach the target processing capacity, an opening degree of the flow rate control valve to control the flow rate of the refrigerant flowing through the bypass passage and to control the heat transfer coefficient ($\alpha i$) of the inside of the heat transfer tube, determine, after controlling the heat transfer coefficient ($\alpha i$) of the inside of the heat transfer tube, whether the processing capacity of the heat exchanger reaches the target processing capacity, and control, in response to a determination after controlling the heat transfer coefficient ($\alpha i$) of the inside of the heat transfer tube that the processing capacity of the heat exchanger does not reach the target processing capacity, opening and closing of each on-off valve to permit or stop flow of the refrigerant through the corresponding one of the heat exchanger segments to control the heat transfer area (A).

2. The air-conditioning apparatus of claim 1, wherein when reducing the heat exchange amount of the heat exchanger, the controller reduces the air flow rate of air blown by the fan to reduce the heat transfer coefficient ($\alpha o$) of the outside of the heat transfer tube, and wherein when the air flow rate of air blown by the fan is lower than a predetermined value, the controller increases the flow rate of the refrigerant flow through the bypass passage to reduce the heat transfer coefficient ($\alpha i$) of the inside of the heat transfer tube.

3. A method for controlling heat exchange amount of a heat exchanger included in an air-conditioning apparatus, the heat exchanger comprises a heat transfer tube through which refrigerant flow and a plurality of heat exchanger segments having capacities different from one another, the method comprising:

determining whether a target processing capacity of the heat exchanger changes, controlling, in response to a determination that the target processing capacity of the heat exchanger changes, an air flow rate blown to the heat exchange to control a heat transfer coefficient ($\alpha o$) of an outside of the heat transfer tube, determining, after controlling the heat transfer coefficient ($\alpha o$) of the outside of the heat transfer tube, whether the processing capacity of the heat exchanger reaches the target processing capacity, controlling, in response to a determination after controlling the heat transfer coefficient ($\alpha o$) of the outside of the heat transfer tube that the processing capacity of the heat exchanger does not reach the target processing capacity, a flow rate of the refrigerant flowing through the heat transfer tube to control a heat transfer coefficient ($\alpha i$) of an inside of the heat transfer tube, determining, after controlling the heat transfer coefficient ($\alpha i$) of the inside of the heat transfer tube, whether the processing capacity of the heat exchanger reaches the target processing capacity, and controlling, in response to a determination after controlling the heat transfer coefficient ($\alpha i$) of the inside of the heat transfer tube that the processing capacity of the heat exchanger does not reach the target processing capacity, permission or stop of the refrigerant to flow through each of the heat exchanger segments to control a heat transfer area (A) of the heat exchanger where the refrigerant exchanges heat with air.

* * * * *